US009662796B2

(12) United States Patent
Scimone et al.

(10) Patent No.: US 9,662,796 B2
(45) Date of Patent: May 30, 2017

(54) CERAMIC CUTTING BLADES

(71) Applicants: Thomas Scimone, Campbell, CA (US); Scott Herbst, San Jose, CA (US); Alan Regala, Seattle, WA (US)

(72) Inventors: Thomas Scimone, Campbell, CA (US); Scott Herbst, San Jose, CA (US); Alan Regala, Seattle, WA (US)

( * ) Notice: Subject to any disclaimer, the term of this patent is extended or adjusted under 35 U.S.C. 154(b) by 48 days.

(21) Appl. No.: 13/870,963

(22) Filed: Apr. 25, 2013

(65) Prior Publication Data

US 2013/0283624 A1 Oct. 31, 2013

Related U.S. Application Data

(60) Provisional application No. 61/638,600, filed on Apr. 26, 2012.

(51) Int. Cl.

| | |
|---|---|
| ***B26B 9/00*** | (2006.01) |
| ***B26B 21/56*** | (2006.01) |
| ***B26B 21/58*** | (2006.01) |

(52) U.S. Cl.

CPC ..... *B26B 9/00* (2013.01); *B26B 21/56* (2013.01); *B26B 21/58* (2013.01)

(58) Field of Classification Search

CPC .. B26B 9/00; B26B 9/02; B26B 21/56; B26B 21/58; A61B 17/3211; A61B 17/3213; A61F 9/0133

USPC ..... 30/2, 351, 355, 356, 162, 346, 346.61, 30/357, 346.5, 346.53

See application file for complete search history.

(56) References Cited

U.S. PATENT DOCUMENTS

| | | | | |
|---|---|---|---|---|
| 1,345,637 | A * | 7/1920 | Sarkozy | A22B 5/168 30/332 |
| 2,464,206 | A * | 3/1949 | Becker | 30/304 |
| 3,094,123 | A * | 6/1963 | Kurtz | A61B 17/06 223/102 |
| 3,543,402 | A * | 12/1970 | Seager | 30/346.53 |
| 3,636,955 | A * | 1/1972 | Kurtz | A61B 17/3211 30/168 |
| 4,064,626 | A * | 12/1977 | Meshulam et al. | 30/287 |
| 4,534,827 | A * | 8/1985 | Henderson | A61B 17/3211 216/101 |
| 5,077,901 | A * | 1/1992 | Warner et al. | 30/357 |
| 5,222,967 | A * | 6/1993 | Casebeer | A61F 9/0133 30/350 |
| 5,337,482 | A | 8/1994 | Schmidt | |
| 5,376,099 | A * | 12/1994 | Ellis | A61F 9/0133 606/166 |
| 5,592,742 | A * | 1/1997 | Okamura | 30/254 |

(Continued)

FOREIGN PATENT DOCUMENTS

| | | | |
|---|---|---|---|
| CA | 2403346 | A1 * | 9/2001 |
| JP | 10015879 | * | 1/1998 |

(Continued)

OTHER PUBLICATIONS

English Translation of JP2001029672.*
English Translation of JP 10015879.*

*Primary Examiner* — Jennifer Swinney
(74) *Attorney, Agent, or Firm* — James M. Smedley LLC; James Michael Smedley, Esq.

(57) ABSTRACT

The present invention generally relates to blades for utility knives, craft knives, box cutters, and other cutting tools. Specifically, this invention relates to cutting blades manufactured from ceramics.

6 Claims, 4 Drawing Sheets

(56) References Cited

U.S. PATENT DOCUMENTS

| | | | | |
|---|---|---|---|---|
| 8,161,654 | B2 * | 4/2012 | Green | 30/346.52 |
| 2003/0019332 | A1 | 1/2003 | Korb et al. | |
| 2004/0187314 | A1 | 9/2004 | Johnson | |
| 2006/0130338 | A1 * | 6/2006 | Dzubak et al. | 30/162 |
| 2007/0101576 | A1 | 5/2007 | Green | |
| 2012/0060379 | A1 | 3/2012 | Culf | |

FOREIGN PATENT DOCUMENTS

| | | | | |
|---|---|---|---|---|
| JP | 2001029672 | A | | 2/2001 |
| JP | 2004051203 | A | * | 2/2004 |

* cited by examiner

CERAMIC CUTTING BLADES

FIELD OF THE INVENTION

The present invention generally relates to blades for utility knives, craft knives, box cutters, and other cutting tools. Specifically, this invention relates to cutting blades manufactured from ceramics.

CROSS-REFERENCE TO RELATED APPLICATIONS

This application claims the benefit of the following provisional application, each of which is hereby incorporated by reference in its entirety: U.S. Pat. App. No. 61/638,600 filed on Apr. 26, 2012 and entitled "Ceramic Box Cutter Blades."

BACKGROUND

The use of utility knives, box cutters, craft knives, and other cutting blades is ubiquitous in commerce as packages are shipped and received at innumerable locations every day. Standard cutting blades are made from metal, which can dull and wear out quickly, requiring frequent replacement and creating a safety hazard when a user must apply more force to make an adequate cut. Furthermore, standard cutting blades are relatively thin and can be difficult to pick-up off of flat surfaces creating a safety hazard where a user may accidentally come into contact with the blade in an effort to lift it of the flat surface.

Therefore, there is a need in the art for cutting blades that have the ability to withstand long term use without dulling and are thicker so that they are easier to handle. These and other features and advantages of the present invention will be explained and will become obvious to one skilled in the art through the summary of the invention that follows.

SUMMARY OF THE INVENTION

Accordingly, it is an aspect of the present invention to provide a ceramic cutting blade that is more durable and has increased wear resistance when compared to a standard cutting blade. Further, it is an aspect of the present invention to provide a cutting blade that is thicker than a standard cutting blade at one or more edges so that the blade is easier to pick-up and handle.

According to an embodiment of the present invention, a ceramic cutting blade, comprising a first edge; and a second edge, wherein said first edge is at least 0.7 millimeters in thickness, wherein said second edge is a cutting edge, wherein said first edge tapers down to form said second edge, wherein said second edge is of a thickness at least 0.01 millimeters less than said first edge.

According to an embodiment of the present invention, the ceramic cutting blade is configured as a utility knife blade.

According to an embodiment of the present invention, the ceramic cutting blade is configured as a box cutter blade.

According to an embodiment of the present invention, the ceramic cutting blade is configured as a razor blade.

According to an embodiment of the present invention, the ceramic cutting blade is configured as a craft knife blade.

According to an embodiment of the present invention, the said ceramic cutting blade further comprises an engagement means.

According to an embodiment of the present invention, the second edge is configured with rounded ends at each side of said second edge.

The foregoing summary of the present invention with the preferred embodiments should not be construed to limit the scope of the invention. It should be understood and obvious to one skilled in the art that the embodiments of the invention thus described may be further modified without departing from the spirit and scope of the invention.

DETAILED SPECIFICATION

Figure 1:
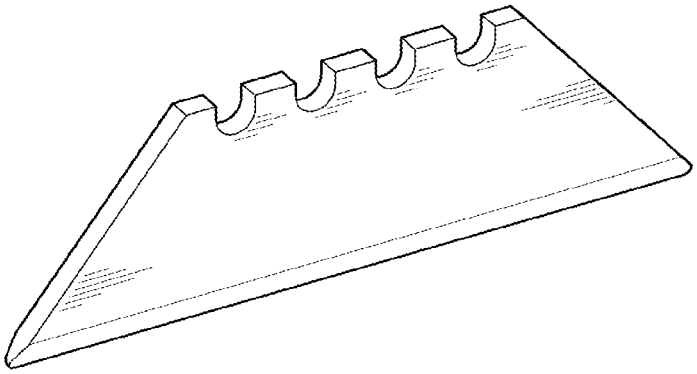
FIG. 1 is perspective view of a ceramic utility knife blade in accordance with an embodiment of the present invention.

The present invention generally relates to blades for utility knives, craft knives, box cutters, and other cutting tools. Specifically, this invention relates to cutting blades manufactured from ceramics.

According to an embodiment of the present invention, the ceramic cutting blades of the present invention are constructed from a ceramic material that is capable of withstanding extended use without becoming dull or unusable. Ceramic materials appropriate for such construction include, but are not limited to, Zirconium Oxide. One of ordinary skill in the art would appreciate that there are numerous ceramic materials that could be utilized with embodiments of the present invention.

According to a preferred embodiment of the present invention, the ceramic cutting blade is comprised of a first edge and a second edge. In a preferred alternate embodiment, the ceramic blade may be comprised of a first edge, a second edge, and an engagement means. In further alternate embodiments, the ceramic cutting blade may be comprised of more or fewer components. One of ordinary skill in the art would appreciate that a ceramic cutting blade could be operably configured with a variety of components, and embodiments of the present invention are contemplated for use with any such component.

According to an embodiment of the present invention, the ceramic cutting blade is comprised of a first edge. In a preferred embodiment, the first edge is between 0.7-2.0 millimeters in thickness, with a favored thickness of 1.0-1.7 millimeters. Standard utility blades have edges that are less than 0.7 millimeters in thickness. In the preferred embodiment, because the first edge is at least 0.7 millimeters in thickness the ceramic cutting blade is easier to handle. According to the preferred embodiment, by making the first edge between 1.0-1.7 millimeters thick the blade is much easier to pick-up when the blade is resting on a flat surface such as a table or work bench. This feature makes the blade safer to handle, as the user can more easily grasp the first edge and need not resort to sliding the blade off the edge of the table or grasping at sharpened portions of the blade, which could lead to injury. Furthermore, the thickness range for the first edge enables the ceramic cutting blade to be configured for a variety of purposes, including, but not limited to, utility knife blades, box cutter blades, razor blades, and craft knife blades. One of ordinary skill in the art would appreciate that there are many safety and other practical advantages of ceramic cutting blade with a first edge that is at least 0.7 millimeters in thickness. Furthermore, one of ordinary skill in the art would appreciate that there are many configurations for a first edge thicker that is at least 0.7 millimeters in thickness, and embodiments of the present invention are contemplated for use with any such configuration.

According to a preferred embodiment of the present invention, an additional advantage of the ceramic blades as described herein is that the increased thickness of the blades make them easier to grasp and pickup when laid flat upon a work surface or other flat surface. Ordinary steel blades can be difficult to pick up, which can result in an increased risk of injury. In fact, one of the riskiest activities regarding the utilization of cutting blades is the changing of a blade. By providing an easy to grasp and pickup ceramic cutting blade, embodiments of the present invention significantly reduce the potential for harm to users and bystanders.

According to a preferred embodiment of the present invention, the ceramic cutting blades are thicker than standard cutting blades. By increasing the thickness, the durability of the ceramic blade is increased. This is especially important due to the fact that ceramics are not flexible like traditional metal blades, making them more prone to snapping and breaking. This is overcome by the increase in thickness. Importantly, the use of ceramic for the cutting blades increases the durability of the cutting blade when compared to traditional metal blades. This is due to the fact that ceramic is harder than metal, allowing ceramic blades to hold their edge longer than traditional metal blades.

According to an embodiment of the present invention, the ceramic cutting blade is comprised of a second edge. In a preferred embodiment, the second edge is of a thickness at least 0.01 millimeters less than said first edge, with a preferred thickness of between 0.7-2.0 millimeters in thickness, with a favored thickness of 1.0-1.7 millimeters. This range in thickness for the second edge enables the ceramic cutting blade to be configured for a variety of purposes, including, but not limited to, utility knife blades, box cutter blades, razor blades, and craft knife blades. In the preferred embodiment, the second edge is the cutting edge. The cutting edge is the sharpened portion of the ceramic cutting blade that is used to cut through material. In the preferred embodiment, the second edge is formed as the ceramic cutting blade tapers down in thickness from the first edge to the second edge. One of ordinary skill in the art would appreciate that the second edge could be operably functional in a number of configurations, and embodiments of the present invention are contemplated for use with any such configuration.

According to a preferred embodiment of the present invention, each end of the second edge is rounded. In the preferred embodiment, each end of the second edge is rounded so that the blade is safer to handle. In particular, rounded edges are safer than edges that come to a point at an angle that creates a sharp point. In this manner, the ceramic blades reduce the risk of puncturing a user or bystander as well as making changing and installing new blades a lower risk proposition than with traditional pointed edges blades. One of ordinary skill in the art would appreciate that that there are numerous configurations for a second edge with rounded ends, and embodiments of the present invention are contemplated for use with any such configuration.

According to an embodiment of the present invention, the ceramic cutting blade is comprised of an engagement means. In a preferred embodiment, the engagement means is configured to allow the ceramic cutting blade to engage, link, or otherwise connect with the cutting tool in which the ceramic cutting blade is being used. In a first preferred embodiment, the engagement means is a hole, channel, or other void in the structure of the ceramic cutting blade that allows the ceramic cutting blade to engage with a pin, clip, post, or other attachment means of a cutting tool. In an alternate preferred embodiment, the engagement means is a notch, dimple, or groove in the ceramic cutting blade that allows the ceramic cutting blade to link together with a corresponding projection on the cutting tool. One of ordinary skill in the art would appreciate that there are many engagement means that would be suitable for use on the ceramic cutting blade, and embodiments of the present invention are contemplated for use with any such engagement means.

In a preferred embodiment of the present invention, the ceramic blades are sharpened at 20 degrees, providing for an efficient and effective blade and cutting surface. One of ordinary skill in the art would appreciate that the ceramic blades may be sharpened at various angles, and embodiments of the present invention are contemplated for use with sharpening at any angle.

Exemplary Embodiments

According to an embodiment of the present invention, the ceramic cutting blade is configured as a utility knife blade. According to a preferred embodiment of the present invention, exemplary dimensions of embodiments of a ceramic utility knife blade may be, for instance, between 1-2 millimeters in width, 25-70 millimeters long and 16-20 millimeters in height. Ceramic blades in this range provide for the desirable increase in strength, durability and usability. One of ordinary skill in the art would appreciate that there are numerous other widths, lengths and heights that may be utilized with embodiments of the present invention, and embodiments of the present invention are contemplated for use with any width, length and height. These size ranges constitute a new form factor of utility knife blade. Exemplary embodiments of the utility knife blades described in this application are thicker than any utility knife blade ever made previously.

Turning now to FIG. 1, a perspective view of a ceramic utility knife blade in accordance with an exemplary embodiment of the present invention is shown. In this embodiment, a ceramic utility knife blade is shown with an increased thickness (when compared to standard utility knife blades)

found in preferred embodiments of the present invention. Additionally, the exemplary embodiment of the ceramic utility knife blade includes a series of notches that function as an engagement means.

Figure 2:
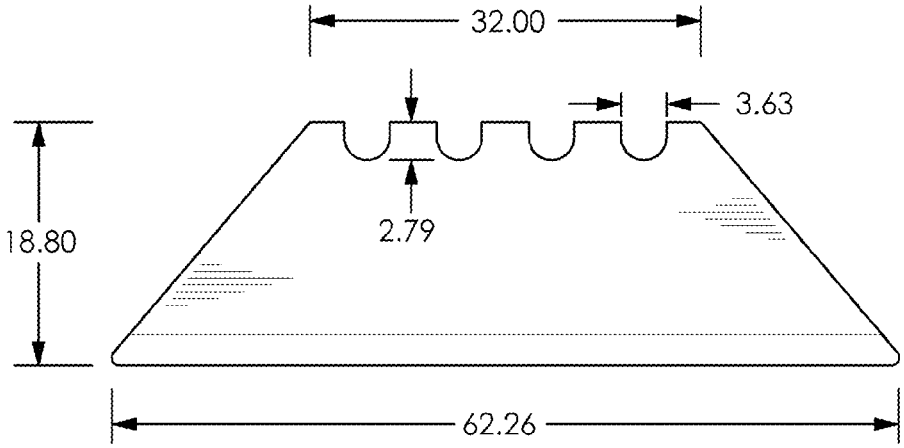
FIG. 2 is front view of a ceramic utility knife blade in accordance with an embodiment of the present invention.

Turning now to FIG. 2, a front view of a ceramic utility knife blade in accordance with an exemplary embodiment of the present invention is shown. In this embodiment, a ceramic utility knife blade is shown that is 18.8 millimeters in height at its greatest point and 62.26 millimeters in width at its widest point. Additionally, the exemplary embodiment of the ceramic utility knife blade includes a series of notches that function as an engagement means.

Figure 3:
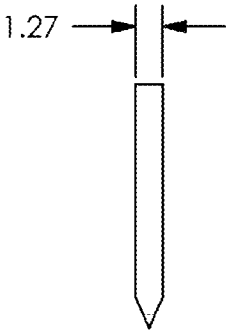
FIG. 3 is side view of a ceramic utility knife blade in accordance with an embodiment of the present invention.

Turning now to FIG. 3, a side view of a ceramic utility knife blade in accordance with an exemplary embodiment of the present invention is shown. In this embodiment, a ceramic utility knife blade is shown that is 1.27 millimeters in thickness at its greatest point.

According to an embodiment of the present invention, the ceramic cutting blade is configured as a box cutter blade. According to a preferred embodiment of the present invention, exemplary dimensions of embodiments of a ceramic box cutter blade may be, for instance, between 1-2 millimeters in width, 25-40 millimeters long and 6-7 millimeters in height. Ceramic blades in this range provide for the desirable increase in strength, durability and usability. One of ordinary skill in the art would appreciate that there are numerous other widths, lengths and heights that may be utilized with embodiments of the present invention, and embodiments of the present invention are contemplated for use with any width, length and height. These size ranges constitute a new form factor of box cutter blade. Exemplary embodiments of the box cutter blades described in this application are thicker than any box cutter blade ever made previously.

Figure 4:
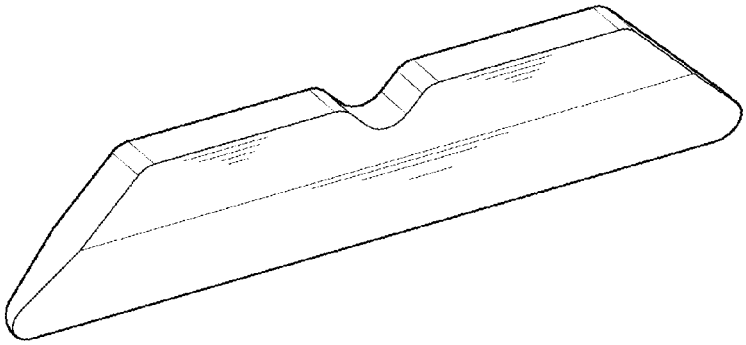
FIG. 4 is perspective view of a ceramic box cutter blade in accordance with an embodiment of the present invention.

Turning now to FIG. 4, a perspective view of a ceramic box cutter blade in accordance with an exemplary embodiment of the present invention is shown. In this embodiment, a ceramic box cutter blade is shown with rounded edges and increased thickness (when compared to standard box cutter blades) found in preferred embodiments of the present invention. Additionally, the exemplary embodiment of the ceramic box cutter blade includes a notch that functions as an engagement means.

Figure 5:
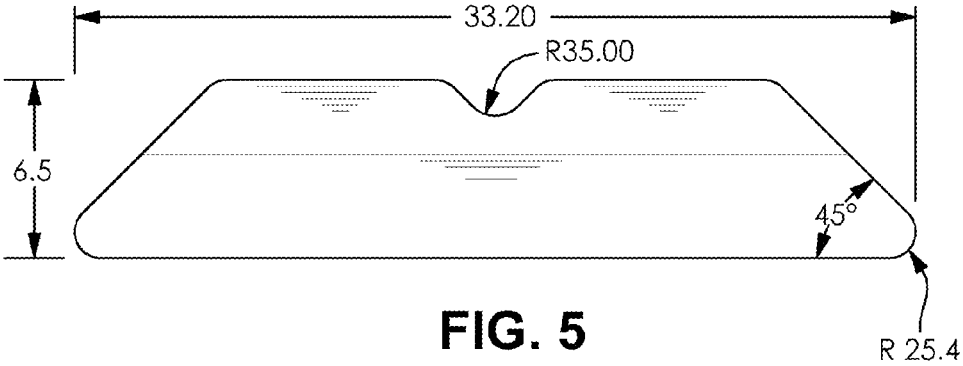
FIG. 5 is front view of a ceramic box cutter blade in accordance with an embodiment of the present invention.

Turning now to FIG. 5, a front view of a ceramic box cutter blade in accordance with an exemplary embodiment of the present invention is shown. In this embodiment, a ceramic box cutter blade is shown that is 6.5 millimeters in height at its greatest point and 33.2 millimeters in width at its widest point. Additionally, the exemplary embodiment of the ceramic box cutter blade includes a notch that functions as an engagement means.

Figure 6:
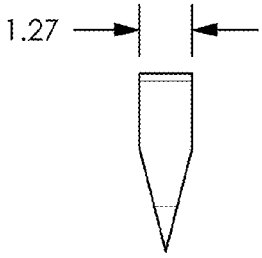
FIG. 6 is side view of a ceramic box cutter blade in accordance with an embodiment of the present invention.

Turning now to FIG. 6, a side view of a ceramic box cutter blade in accordance with an exemplary embodiment of the present invention is shown. In this embodiment, a ceramic box cutter blade is shown that is 1.27 millimeters in thickness at its greatest point.

According to an embodiment of the present invention, the ceramic cutting blade is configured as a razor blade. According to a preferred embodiment of the present invention, exemplary dimensions of embodiments of a ceramic razor blade may be, for instance, between 1-2 millimeters in width, 30-50 millimeters long and 15-20 millimeters in height. Ceramic blades in this range provide for the desirable increase in strength, durability and usability. One of ordinary skill in the art would appreciate that there are numerous other widths, lengths and heights that may be utilized with embodiments of the present invention, and embodiments of the present invention are contemplated for use with any width, length and height. These size ranges constitute a new form factor of razor blade. Exemplary embodiments of the razor blades described in this application are thicker than any razor blade ever made previously.

Figure 7:
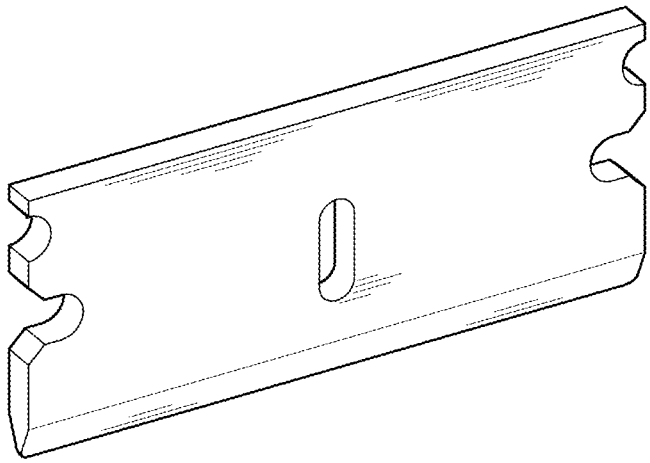
FIG. 7 is perspective view of a ceramic razor blade in accordance with an embodiment of the present invention.

Turning now to FIG. 7, a perspective view of a ceramic razor blade in accordance with an exemplary embodiment of the present invention is shown. In this embodiment, a razor blade is shown with increased thickness (when compared to standard razor blades) found in preferred embodiments of the present invention. Additionally, the exemplary embodiment of the ceramic box cutter blade includes a series of notches that function as an engagement means.

Figure 8:
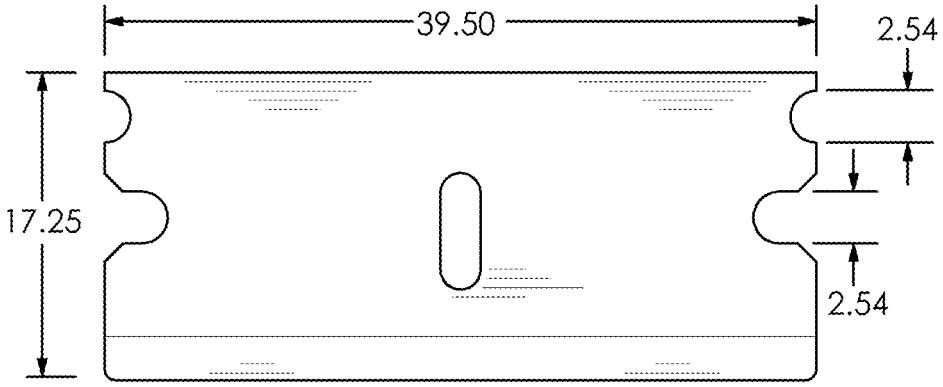
FIG. 8 is front view of a ceramic razor blade in accordance with an embodiment of the present invention.

Turning now to FIG. 8, a front view of a ceramic razor blade in accordance with an exemplary embodiment of the present invention is shown. In this embodiment, a ceramic box cutter blade is shown that is 17.25 millimeters in height at its greatest point and 39.5 millimeters in width at its widest point. Additionally, the exemplary embodiment of the ceramic box cutter blade includes a series of notches that function as an engagement means.

Figure 9:
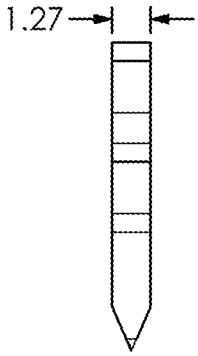
FIG. 9 is side view of a ceramic razor blade in accordance with an embodiment of the present invention.

Turning now to FIG. 9, a side view of a ceramic razor blade in accordance with an exemplary embodiment of the present invention is shown. In this embodiment, a ceramic razor blade is shown that is 1.27 millimeters in thickness at its greatest point.

According to an embodiment of the present invention, the ceramic craft knife blade is configured as a craft knife blade. According to a preferred embodiment of the present invention, exemplary dimensions of embodiments of a ceramic craft knife blade may be, for instance, between 1-2 millimeters in width, 20-40 millimeters long and 4-8 millimeters in height. Ceramic blades in this range provide for the desirable increase in strength, durability and usability. One of ordinary skill in the art would appreciate that there are numerous other widths, lengths and heights that may be utilized with embodiments of the present invention, and embodiments of the present invention are contemplated for use with any width, length and height. These size ranges constitute a new form factor of craft knife blade. Exemplary embodiments of the craft knife blades described in this application are thicker than any craft knife blade ever made previously.

Figure 10:
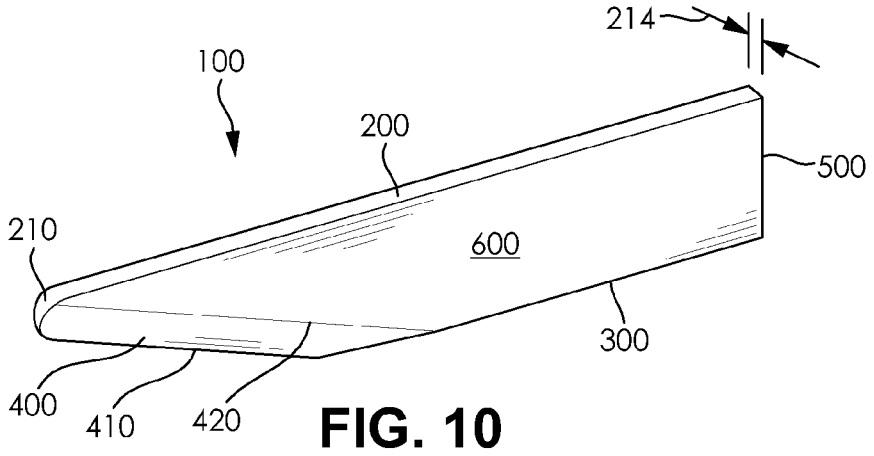
FIG. 10 is perspective view of a ceramic craft knife blade in accordance with an embodiment of the present invention.

Turning now to FIG. 10, a perspective view of a ceramic craft knife blade in accordance with an exemplary embodiment of the present invention is shown. In this embodiment, a craft knife blade is shown with increased thickness (when compared to standard craft knife blades) found in preferred embodiments of the present invention. The ceramic craft blade 100 includes a first side 200, and a second opposite side 300 parallel to and shorter than the first side. The ceramic blade also has a right front beveled surface 400 and a left front beveled surface 402 which converge to form a leading edge 410. The rear side 500 of the blade is opposite the leading edge 410. The first side 200 has a first end and an opposite end, where the first end forms a right angle with the rear side 500, and the opposite end curves down, forming a rounded corner that tapers into the leading edge 410.

The ceramic craft blade also has a right planar side 600 and a left planar side 700. Together, the first side, second side, front leading edge, and rear side, left planar side and right planar side define a right-angled trapezoid shaped cutting blade body, where the front leading edge is slanted to form an obtuse angle between the second side 300 and the leading edge.

The front left and right beveled surfaces 400 and 402 extend from the left and right planar sides, respectively.

Furthermore, the left and right beveled surfaces are in different planes than the left and right planar sides, thus forming angled surfaces relative to the left and right planar sides, respectively. A right side transition edge 420 and left side transition edge 430 delineate the right and left planar sides from the right and left beveled surfaces. The right and left beveled surfaces converge symmetrically from each respective transition edge to define the leading edge 410 which forms a cutting edge. In addition, each respective transition edge 420 and 430 is parallel to the leading edge 410.

Figure 11:
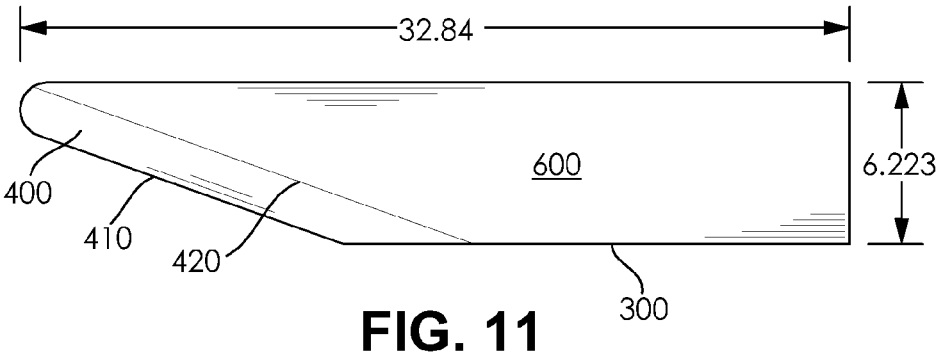
FIG. 11 is side view of a ceramic craft knife blade in accordance with an embodiment of the present invention.

Turning now to FIG. 11, a side view of a ceramic craft knife blade in accordance with an exemplary embodiment of the present invention is shown. In this embodiment, a ceramic craft knife blade is shown that is 6.223 millimeters in height at its greatest point and 32.84 millimeters in width at its widest point. As shown in FIGS. 10 and 11, the ceramic cutting blade has a single rounded corner 210 between the first side 200 and the leading edge 410. A front view of the ceramic craft blade depicted in FIG. 12 shows a front profile view of the rounded corner and the left and right beveled surfaces 400 and 402.

Figure 12:
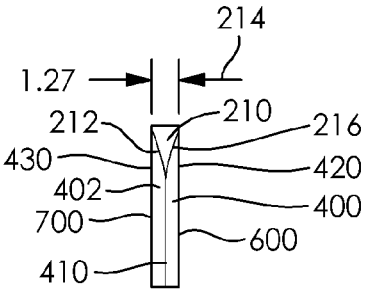
FIG. 12 is a front end view of a ceramic craft knife blade in accordance with an embodiment of the present invention.

Turning now to FIG. 12, a front end view of a ceramic craft knife blade in accordance with an exemplary embodiment of the present invention is shown. In this embodiment, a ceramic craft knife blade is shown that is 1.27 millimeters in thickness at its greatest point. As further shown in FIG. 12, the rounded corner 210 has a front profile of a triangle. A rear side thickness 214 of the blade defines the base of the triangle, and top peripheral edges 212 and 216 of the left and right beveled surfaces define the legs of the triangle. The leading edge 410 extends from the apex of said triangle to the second side 300 and extends centrally between the right and left planar sides.

It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

The invention claimed is:

1. A ceramic cutting blade, comprising a first side having a first end and an opposite end;

a second opposite side shorter than said first side and parallel to said first side;

front left and right beveled surfaces that converge to form a leading edge;

a rear side, opposite said leading edge;

a right planar side; and a left planar side, wherein said right beveled surface extends from said right planar side into a different plane than said right planar side, and said left beveled surface extends from said left planar side into a different plane than said left planar side, wherein a transition edge on both sides of said blade delineates said right and left planar surfaces from said right and left beveled surfaces, respectively, wherein said first end of said first side curves down, forming a rounded corner that tapers into said leading edge, wherein said first side, second side, leading edge, and rear side, left planar side and right planar side define a right-angled trapezoid shaped cutting blade body, wherein the leading edge is slanted to form an obtuse angle between said second side and said leading edge, wherein said left and right beveled surfaces converge symmetrically from each respective transition edge to define said leading edge which forms a cutting edge, wherein each respective transition edge is parallel to said leading edge, wherein said rounded corner has a front profile of triangle, wherein a thickness of said rear side defines the base of said triangle and top peripheral edges of said left and right beveled surfaces define the legs of said triangle, wherein the leading edge extends from an apex of said triangle to the second side of said ceramic cutting blade, wherein said ceramic blade is made of zirconium oxide and has a thickness of 1-2 mm, a length of 20-40 mm, and a height of 4-8 mm.

2. The ceramic cutting blade of claim 1, wherein said ceramic cutting blade is configured as a utility knife blade.

3. The ceramic cutting blade of claim 1, wherein said ceramic cutting blade is configured as a box cutter blade.

4. The ceramic cutting blade of claim 1, wherein said ceramic cutting blade is configured as a razor blade.

5. The ceramic cutting blade of claim 1, wherein said ceramic cutting blade is configured as a craft knife blade.

6. The ceramic cutting blade of claim 1, wherein a long side of said ceramic cutting blade is 32.84 millimeters.

* * * * *